United States Patent [19]

Bone

[11] 4,416,407

[45] Nov. 22, 1983

[54] DISPENSING OF FASTENERS WITH A PIVOTED AND DISENGAGEABLE FEED MECHANISM

[75] Inventor: Arnold R. Bone, Needham, Mass.

[73] Assignee: Dennison Manufacturing Company, Framingham, Mass.

[21] Appl. No.: 317,218

[22] Filed: Nov. 2, 1981

[51] Int. Cl.[3] ..... B25C 5/11

[52] U.S. Cl. ..... 227/67; 221/274

[58] Field of Search ..... 227/67, 73; 221/274, 221/276

[56] References Cited

U.S. PATENT DOCUMENTS

| | | | |
|---|---|---|---|
| 3,888,402 | 6/1975 | Bone | 227/67 X |
| 3,924,788 | 12/1975 | Furutu | 227/67 |
| 4,049,177 | 9/1977 | Bussard | 227/67 |
| 4,049,178 | 9/1977 | Strausburg | 227/67 |
| 4,288,017 | 9/1981 | Russell | 227/67 |

*Primary Examiner*—Fred Silverberg

*Attorney, Agent, or Firm*—George E. Kersey; A. B. Moore; B. D. Josephs

[57] ABSTRACT

Dispensing of fasteners by a device which receives an assemblage of the fasteners and is able to expel them individually through, for example, a slotted hollow needle. The dispensed fasteners can be used generally in the attachment of items to one another and, in particular, for the labeling of textile goods and the like with information bearing tags. The device includes a trigger operated feed mechanism and a simultaneously operable expulsion mechanism. Both mechanisms are controlled by the tip of a lever which is proportioned and disposed in the device to execute linear motion. The feed mechanism is disengageable from the remainder of the device to permit clearance of the inserted assemblage or the removal of jams. The feed mechanism additionally is operated by a planar pawl having a tooth that extends into contact with indentations on the periphery of a feed wheel.

17 Claims, 10 Drawing Figures

DISPENSING OF FASTENERS WITH A PIVOTED AND DISENGAGEABLE FEED MECHANISM

BACKGROUND OF THE INVENTION

This invention relates to the dispensing of fasteners, particularly fasteners which are included in an assemblage from which individual fasteners are dispensed as desired.

One common form of fastener is of the type disclosed in U.S. Pat. Nos. 3,103,666; 3,444,597; 3,733,657; and 4,039,078. The individual fasteners in assemblages of the kind disclosed in the foregoing patents include opposite end members that are interconnected by a transverse segment commonly designated a "filament". Generally one of the end members is a "cross bar" in the form of a short cylindrical element disposed at a right angle to the filament and proportioned to be dispensed through the bore of a slotted hollow needle. In the course of dispensing a fastener, its cross bar is moved through the bore with the filament extending through the slot of the needle. The member opposite the cross bar is in accordance with the intended function of the fastener. One common form of opposite end member is a transverse enlargement commonly known as a "head" or "paddle". It is used, for example in supporting an information bearing tag which is attached to an item of merchandise such as a garment by the dispensing device.

The dispensers for such fasteners are generally of the kind disclosed in U.S. Pat. Nos. 3,103,666; 3,470,834; Re 29,310; 3,893,612; 3,875,648; and 4,111,347.

The expulsion mechanism of the foregoing dispensing devices generally includes an elongated slide as shown in U.S. Pat. Nos. 3,103,666 and Re. 29,310 in order to achieve simultaneous operation of the feed mechanism and the plunger by which individual fasteners are expelled from the device.

An alternative construction is of the type shown in U.S. Pat. Nos. 3,650,451; 3,650,452; and 3,924,788. This construction requires that the housing for the dispensing apparatus allow for the pivotting of a lever which acts upon the feed and dispensing mechanisms. The result is an increase in bulk over and above what would otherwise be required.

In addition it is desirable to provide a release mechanism to permit clearing of the device or release of any occasional jams that may occur. One type of release mechanism operates only when the trigger is depressed. This is cumbersome and inoperable in many situations. Another type of release mechanism disables both the drive and feed mechanisms of the gun. This adds complexity to the mechanism. It is additionally undesirable since operation of the drive mechanism is often useful in clearing a jam. Thus if the drive is interrupted during clearance, the clearance procedure becomes more difficult to accomplish. Still another type of release mechanism disables the feed mechanism at a portion remote from the pawl. As a result the clearance procedure must be undertaken with care.

Another characteristic of the ordinary dispensing device is that the feed takes place using a pawl which engages, for example, sprocket teeth of a feed wheel. In the ordinary construction there is a significant amount of wear that takes place in the pawl over the course of time. The result is that the ordinary attacher gun has a limited life. It is not possible for the customer to repair the worn pawl and the dispensing device must therefore be returned to a service center for repair.

Accordingly, it is an object of the invention to facilitate the dispensing of fasteners. A related object is to facilitate the dispensing of individual fasteners from an assemblage in which each individual fastener includes end members that are joined by a cross member commonly referred to as a filament.

A further object of the invention is to simplify the control lever that is used in actuating both the feed and expulsion mechanisms simultaneously. A related object is to achieve compactness in the design of devices for dispensing fasteners by reducing slide length and eliminating the customary pivoted lever of the prior art.

Still another object of the invention is to facilitate the release of assemblages that have been inserted into dispensing devices, as well as the clearance of jams. A related object is to achieve release and clearance without disabling the drive function of the device.

Another object of the invention is to prolong the life of the device by reducing the incidence of wear that commonly takes place between a feed pawl and a drive sprocket. A related object is to achieve increased wear with a simplified pawl.

SUMMARY OF THE INVENTION

In accomplishing the foregoing and related objects the invention provides a dispenser which receives and feeds an assemblage of fasteners and expells individual ones of the fasteners. The expulsion and feed of the fasteners is controlled by a lever which has a tip that moves along a linear path.

In accordance with one aspect of the invention the control lever is operated by a trigger that is pivotally connected to the device and includes a fixed projection which moves along a slot of the lever.

In accordance with another aspect of the invention a link is pivotally connected to the control lever between its end positions and pivotally attached to the device. The link is desirably spring biased at its pivot position by a support rod that extends from the pivot position to a trigger and enters an apertured portion of the trigger, with the support rod surrounded by a coil spring.

In accordance with a further aspect of the invention, expulsion of the fasteners is achieved by a plunger pivotally secured to the lever, while feeding takes place using a slide containing spaced-apart projections on opposite sides of the lever, which engages the projections during the feeding operation.

In accordance with yet another aspect of the invention the dispenser includes a linkage with two separate pivot positions for controlling the feed of fasteners. Feeding takes place with a feed wheel having peripheral indentations for engaging the fasteners and a pawl that is pivotally connected to the double pivot linkage. This construction reduces the incident wear in the feed mechanism which advantageously includes a slide pivotally connected to the linkage.

In accordance with a yet further aspect of the invention, feeding takes place by a pawl in the form of a planar member with a transverse tooth that engages a feed wheel. The pawl is pivotally connected to a linkage which is further pivotally connected to a slide. The latter includes spaced-apart projections that are successively engaged during the feeding of fasteners by engagement of a trigger operated lever. The projections are desirably in the form of cylindrical posts of unequal size to permit final adjustment of the stroke in the manufacture of the device.

In accordance with still another aspect of the invention, the dispenser for fasteners includes a feed pawl with an antibackup member and a further member for simultaneously disengaging the feed pawl and the antibackup. The disengagement member desirably engages a planar portion of the feed pawl. The disengagement desirably moves transversely with respect to the direction of feed of fasteners and includes a shoulder that disengages the antibackup member.

In accordance with yet another aspect, the disengagement member releases the feed pawl from the feeding mechanism without affecting the drive portion of the device.

In accordance with still another aspect of the invention, the dispenser is provided with a frontal configuration that facilitates the use of the device in the labeling of merchandise. This is accomplished in part by the provision of a flatenned nose with a lower concavely curved lip that accommodates the index finger of the operator and by the position of the operating trigger closer to the nose than in other devices. In addition a curved exit chute is provided for the runners that are associated with the fasteners to direct the exiting runners away from the fingers of the operator and limit the inconvenience and interference associated with runner expulsion in other dispensers.

DESCRIPTION OF THE DRAWINGS

Other aspects of the invention will become apparent after considering several illustrative embodiments taken in conjunction with the drawings in which.

DETAILED DESCRIPTION

Figure 1:
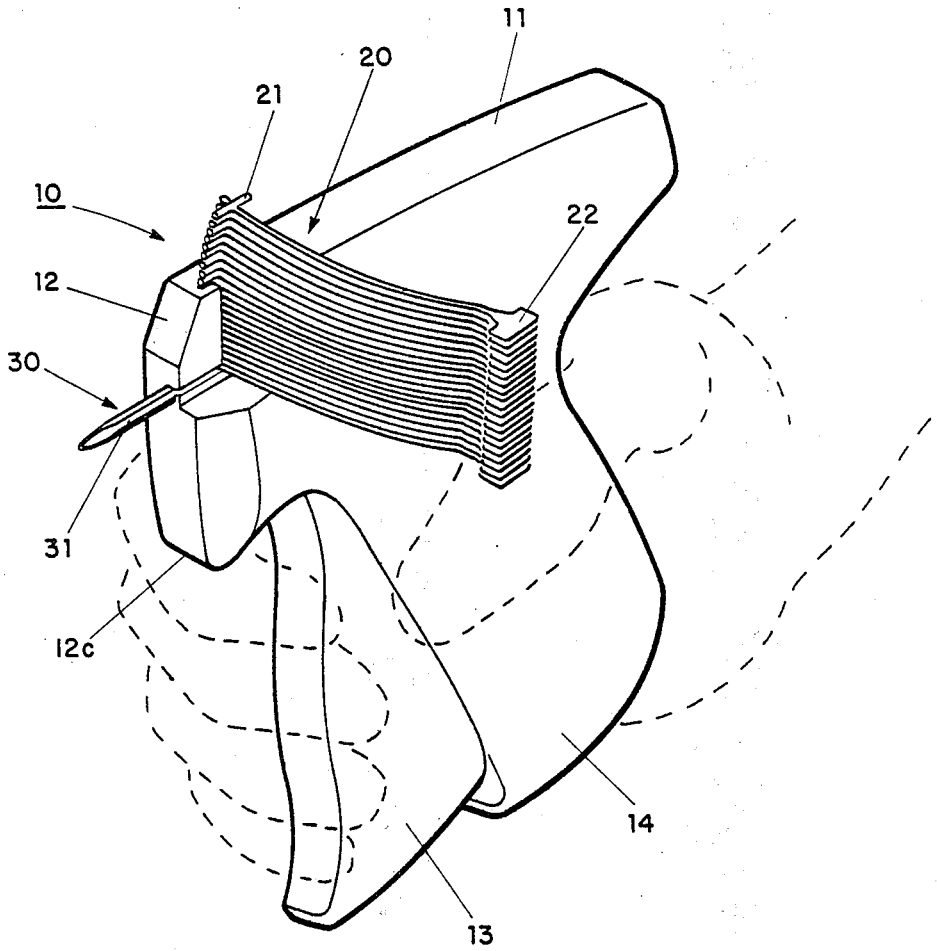
FIG. 1 is a perspective view of a device for dispensing fasteners in accordance with the invention.

With reference to the drawings, FIG. 1 depicts a dispenser 10 for the controlled pistol grip expulsion of fasteners 20. A user's hand, indicated in phantom, grips the dispenser 10 in the fashion of a pistol, with the result that the dispenser 10 can be regarded as a pistol grip dispenser.

The particular dispenser 10 of FIG. 1 expels successive fasteners from a clip 20 along the bore of a slotted hollow needle 30. As illustrated below, individual fasteners are dispensed by being fed successively into alignment with the bore of the needle 30. Each fastener is then expelled through the bore with its filament 22 extending outwardly through the slot 31 of the needle 30.

In an illustrative use, a merchandising tag (not shown) is positioned on the needle 30 against the front end 12 of the dispenser 10. The needle is then inserted into an item of merchandise to be tagged. When the trigger 13 is operated by being depressed into the pistol grip housing or handle 14, a cross bar 21 is moved along the bore of the needle 30 until it is expelled on the reverse side of the garment. When the dispenser 10 is withdrawn, the cross bar 21 is on the opposite side of the garment and the filament extends through the garment to the tag which rests against a head 22.

In order to promote the utility of the dispenser 10, the invention provides, among other things, a plunger lever with a linear operated tip, as described below, by contrast with the pivotted levers of the prior art which require an enlarged area in the housing for lever swing during each dispensing operation. As a result of the linear path provided for the tip of the lever operating the plunger, the dispenser 10 is of limited height. This promotes the usability of the product by permitting better visibility in tagging operation.

In addition, the dispenser 10 permits ready clearance of the passageway into which the clip of fasteners 20 is inserted. Such clearance can be helpful in the event of a jam in the needle or elsewhere in the dispenser. The invention also provides a limited possibility of jamming by the use of a double pivot for controlling the feed mechanism that is used to advance the individual fasteners into position for being dispensed.

Figure 2A:
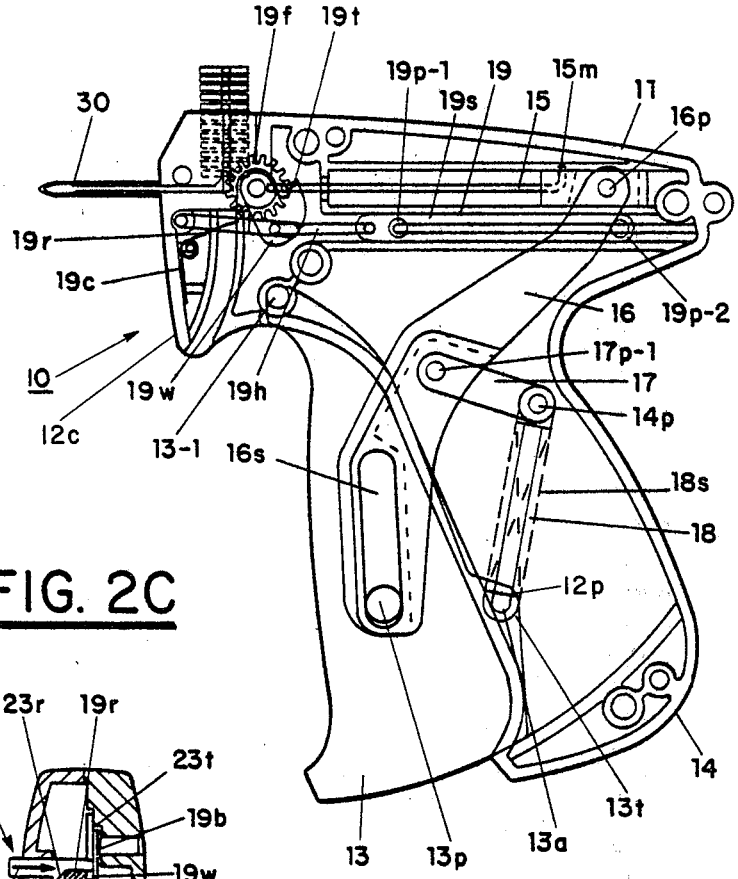
FIG. 2A is a cross-sectional view of the interior of the dispenser of FIG. 1.

The features provided by the invention are illustrated in the cross-sectional view of FIG. 2A. A plunger 15 is reciprocated in the upper portion of the housing 10 by a pivotally connected control lever 16. The latter is operated by the trigger 13 which contains a post 13*p* that confines the motion of the lever 16 with respect to a slot 16*s*. Because the tip of the lever 16 moves linearly, it can be pivotally connected at position 16*p* to the plunger mount 15*m*.

The desired linear motion of the pivot 16*p* is achieved by the use of a link 17 that is in turn pivotally connected at a position 17*p*-1 intermediate the ends of the lever 16. The opposite end of the link 17 is pivotally fixed to the handle 14 at a position 14*p*. Desired biasing is provided by a spring 18*s* which is compressed as a supporting post 18 is depressed into an aperture 13*a* at a pivot position 13*t* of the trigger 13.

In addition to reciprocating operation of the plunger 15, the lever 16 also serves to control the feed mechanism 19. The latter consists of a slide 19*s* with spaced-apart posts 19*p*-1 and 19*p*-2 between which the upper portion of the lever 16 is movable during reciprocation of the plunger 15.

The forward portion of the slide 19 is pivotally connected to a pawl 19*w* by a link 19*h*. The pawl 19*w* contains a tooth 19*t* which acts upon a feed wheel 19*f* during reciprocation of the slide 19 by virtue of the linear motion of the pivot point 16*p* associated with the lever 16. The feed wheel 19*f* is restrained by a lever 19*r* which is maintained in position against the feed wheel 19*f* by a torsional spring 19*c*. The latter has one extended arm which bears against the lever 19*r* and another which bears against the frontal inside surface of the housing 10. The pawl 19*w* is resiliently held against the face of the feed wheel 19*f* by a curve biasing washer 19*b*. This washer provides sufficient resiliency so that the pawl tooth 19*t* can move the feed wheel and also allow pawl disengagement as explained below.

Figure 3A:
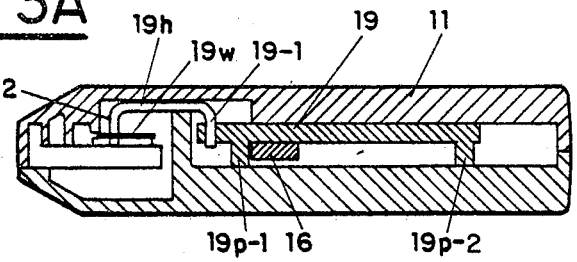
FIG. 3A is a sectional view showing a pivoted feed linkage mechanism in accordance with the invention.
Figure 3B:
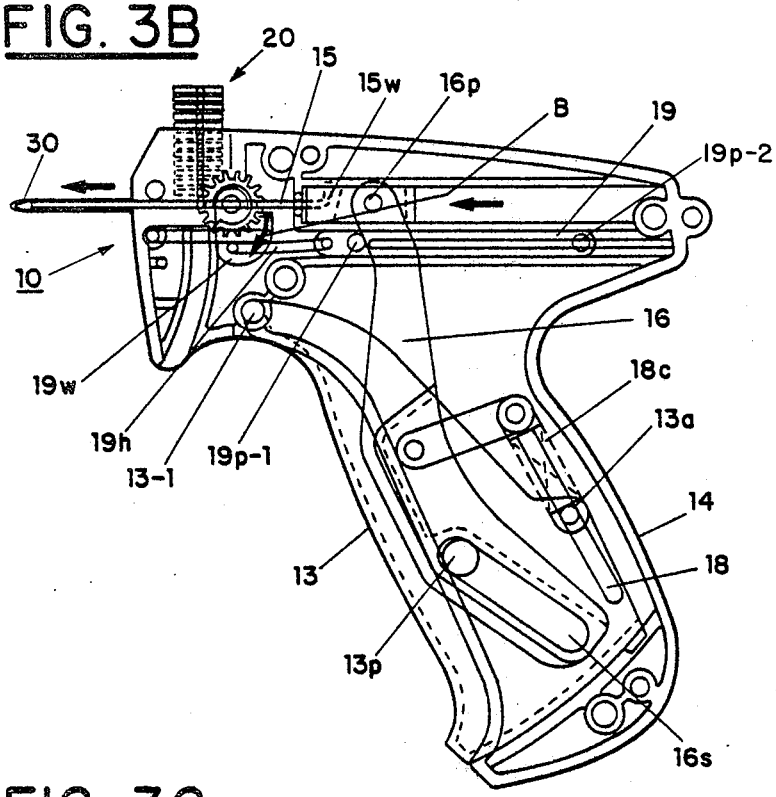
FIG. 3B is a sectional view showing the dispenser of FIG. 1 in the course of being operated to expel a fastener.
Figure 3D:
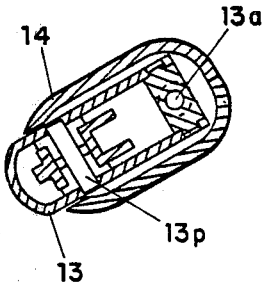
FIG. 3D is a sectional view of the handle portion of the dispenser of FIG. 3B.
Figure 3C:
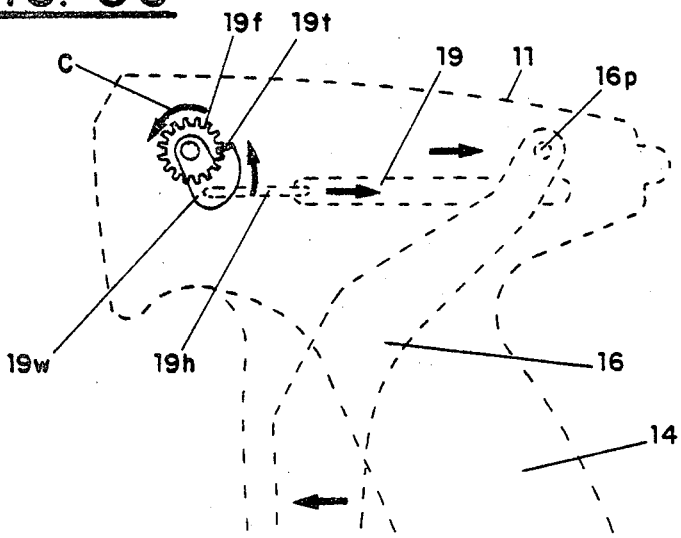
FIG. 3C is a phantom view illustrating the operation of the feed mechanism for the dispenser of FIGS. 1, 2A and 3A.

When the feed slide 19 is moved forwardly, by engagement of the lever 16 with the post 19*p*-1, the pawl is moved in a clockwise direction of the arrow B as illustrated in FIG. 3B, with the tooth 19*t* clearing the teeth of the feed wheel 19*f* because the latter is prevented from moving by the antibackup lever 19*r*. When the lever 16 is released, the sequence of events is as indicated in FIG. 3C, with the tooth 19*t* of the pawl 19*w* engaging a tooth of the feed wheel 19*f* and moving it in the counterclockwise direction indicated by the arrow C in FIG. 3C.

Figure 2B:
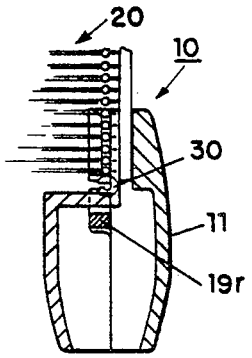
FIG. 2B is a sectional view of the dispenser of FIG. along the entry channel for the fasteners in being dispensed.
Figure 2C:
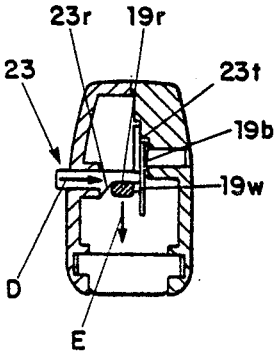
FIG. 2C is a sectional view of a disengagement mechanism in accordance with the invention.

In the event that a jam occurs, for example during the successive feeding of fasteners of the clip 20 shown in FIG. 2B, a release slide 23 is operated, having the construction illustrated in FIG. 2C. The release slide 23, when depressed along the direction indicated by the arrow D disengages the antibackup lever 19*r* from the feed wheel 19*f* and simultaneously disengages the pawl 19*w* from the feed wheel 19*f*. As noted above the washer 19*b* returns the pawl to operating position when the slide 23 is released.

As indicated in FIG. 2C, before the translation force is applied to the release slide 23 a narrow tip 23*f* is in contact with a side face of the pawl 19*w* and a ramp 23*r* is in position for pivotting the antibackup lever 19*r* downwardly as indicated by the phantom arrow E in FIG. 2C.

Figure 2D:
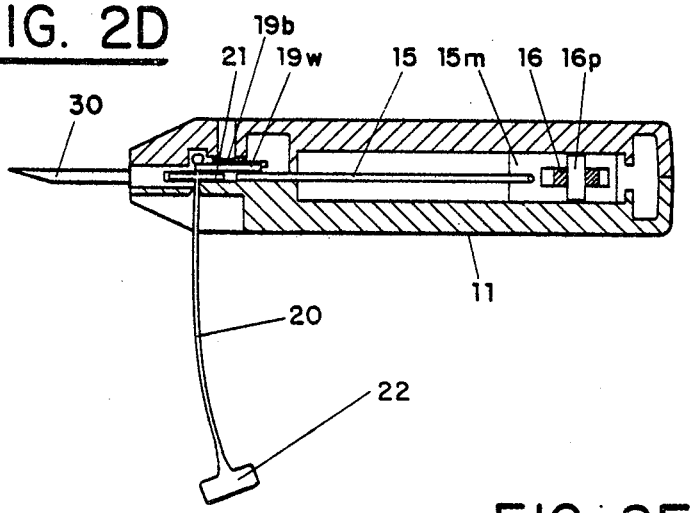
FIG. 2D is a top sectional view of the dispenser of FIG. 1 showing a fastener in position for being dispensed.

A fastener in position for being dispensed is shown in FIG. 2D before contact is made with its cross bar 21 by the tip of the plunger 15.

Figure 2E:
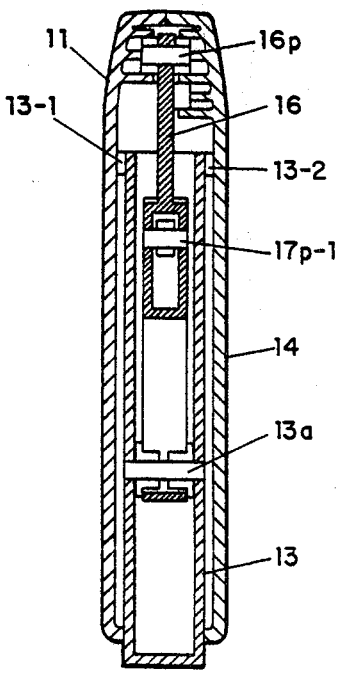
FIG. 2E is a sectional view of the rear portion of the dispenser of FIG. 1 including its handle.

In the cross-sectional view of FIG. 2E the various components of the lever mechanism in relation to the handle 14 is shown. In particular the trigger 13 is fixed pivotally at pivot points 13-1 and 13-2 and includes a platform 12*p* through which the support post 18 is able to be depressed when the trigger 13 is squeezed into the handle 14.

A specific view showing the relationship of the link 19*h* to the pawl 19*w* and the slide 19 at pivot points 19-1 and 19-2 is shown in FIG. 3A. It is the double pivot connection of FIG. 3A that permits a dispenser in accordance with the invention to provide extended life for the pawl 19*w* and simultaneously limit the likelihood that a jam will occur or a malfunction will occur by virtue of improper operation of the feed slide 19.

FIG. 3B shows the dispenser 10 with the trigger 13 fully depressed into the handle 14. In this position the lever 16 has its tip at the pivot 16*p* of the mounting block 15*m* and the plunger 15 is in its most forward position with the tip of the plunger fully forward in the needle 30, the fastener 20 of FIG. 2D having been fully expelled. In this position the lever 16 rests against the forward post 19*p*-1 of the feed mechanism 19 with the pawl 19*w* in its lowermost position by virtue of the forward motion of the link 19*h*.

When the trigger 13 is released, the result, as noted above is in accord with FIG. 3C. The link 19*h* moves upwardly at the same time that the feed mechanism 19 moves rearwardly. The upward motion of the link produces a pivotting action of the pawl 19*w*, and the tooth 19*t* of the pawl 19*w* engages a feed notch of the feed wheel 19*f* and rotates it in a counterclockwise direction by one notch position to advance the fasteners 20 of FIG. 3B so that the lowermost fastener is in line with the bore of the needle 30.

Referring again to FIG. 3B it is seen that with the trigger 13 fully depressed the post 13*p* occupies the uppermost position of the slot 16*s* in the lever 16. It is also seen that the supporting post 18 is fully depressed through the aperture 13*a* and the spring 18*s* is fully compressed. These matters are further illustrated in the cross-sectional view of FIG. 3D.

It will be noted that the frontal portion of the dispenser 10 is specifically configured to facilitate use of the device in the tagging of merchandise. The front 12 below the needle 30 has a surface with a curvature that forms an angle of less than 15° with a line of tangency at the needle mounting position. As a result there is a surface at the front of the dispenser below the needle that is particularly suitable for the positioning and retention of a tag on the needle during the tagging operation. It is customary for users to place a tag that is to be applied to merchandise on the needle and hold that tag during the tagging operation. Prior art dispensers made it relatively cumbersome and inconvenient to maintain the tag in position at the front of the gun. As a result during use of the gun the tags commonly fell from the needle with an attendant disruption and delay in the tagging operation. The frontal surface provided by the invention permits the operator to position the tag on the needle in the customary way and hold the balance of the tag on the frontal surface with the forefinger. This has significantly increased the efficiency with which this type of dispenser can be used. Moreover the front 12 is provided with a chin point 12*c* which extends to the trigger 13 by an arc that accommodates the middle finger of the user and further promotes facility in the use of the dispenser. Additional advantage is also achieved by location of the pivot point 13-1 and 13-2 at a position which is below the axis of the feed wheel 19*f* and along the tangency to the notch position of the feed wheel at the axis for the plunger 15. It is important in this context that the handle 13 have a tangent from the pivot position 13-1 to its central gripping surface no greater than 30°. The front profile of the trigger essentially forms a right angle with respect to the axis of feed for the device. This angle can vary between approximately 85° and 95°.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. Apparatus for dispensing fasteners comprising a device for receiving an assemblage of fasteners;

means for feeding the fasteners received by said device; and a pivoting linkage having two separate pivot points at opposite ends of said link for controlling the feeding means;

wherein the feeding means includes a reciprocal slide and a feed pawl pivotally connected to respective opposite ends of said link at said separate pivot points;

said slide includes spaced apart projections which are successively engaged during the feeding of said fasteners; and said projections are engaged by a lever which is operated by a trigger of said device.

2. Apparatus as defined in claim 1 wherein the feeding means includes a feed wheel having peripheral indentations for engaging individual ones of said fasteners and the feed pawl operates said feed wheel.

3. Apparatus as defined in claim 1 wherein the feed pawl is in the form of a planar member.

4. Apparatus as defined in claim 1 wherein said lever is positioned between said projections of said slide.

5. Apparatus as defined in claim 4 wherein said projections are in the form of cylindrical posts.

6. Apparatus as defined in claim 5 wherein said projection posts are of unequal size.

7. Apparatus as defined in claim 1 wherein said lever engages said feeding means along a linear path.

8. Apparatus as defined in claim 7 wherein said trigger is pivotally connected to said apparatus and includes a fixed projection which moves along a slot of said lever for the control thereof.

9. Apparatus as defined in claim 1 further including a link pivotally connected to said lever by the end positions thereof and pivotally connected to said apparatus.

10. Apparatus as defined in claim 1 wherein said device includes a slotted hollow needle at the frontal portion thereof through which said fasteners are expelled individually.

11. Apparatus as defined in claim 1 wherein said trigger is pivotally mounted on said device along a line of tangency with a feed wheel of said device with said line of tangency being perpendicular to the axis of said fasteners.

12. Apparatus as defined in claim 1 wherein the device includes a slotted hollow needle at the frontal portion thereof through which said fasteners are expelled individually; and said device has a frontal portion below said needle which lies within an angle no greater than 15° at a plane tangent to said frontal portion at the position of said needle.

13. Apparatus as defined in claim 1 wherein said trigger is pivotally mounted and has a central finger gripping portion with a line of tangency that extends to the axis of feed of the device and forms therewith an angle in the range from 85° to 95°.

14. Apparatus for dispensing fasteners comprising a device for receiving and feeding an assemblage of fasteners, including a feed pawl and an antibackup mechanism for said feed pawl; and means for simultaneously disengaging said feed pawl and said antibackup mechanism;

wherein the disengaging means comprises a member with a shoulder for engaging said antibackup mechanism.

15. Apparatus as defined in claim 14 wherein said feed pawl includes a planar portion and the disengagement means is engageable with that planar portion.

16. Apparatus as defined in claim 14 wherein the disengaging means comprises a member which is movable transversely with respect to the direction of feed of said attachments.

17. Apparatus as defined in claim 14 wherein the means for disengaging said feed pawl from the feeding mechanism operates without affecting the drive portion thereof.

* * * * *